US007082966B2

(12) United States Patent
Kuo

(10) Patent No.: US 7,082,966 B2
(45) Date of Patent: Aug. 1, 2006

(54) WATER-FLOW GUIDE DEVICE OF FAUCET

(76) Inventor: Lian-Jie Kuo, P.O. Box 96-405, Taipei 106 (TW)

( * ) Notice: Subject to any disclaimer, the term of this patent is extended or adjusted under 35 U.S.C. 154(b) by 41 days.

(21) Appl. No.: 11/011,174

(22) Filed: Dec. 15, 2004

(65) Prior Publication Data

US 2006/0124183 A1 Jun. 15, 2006

(51) Int. Cl.
*E03C 1/04* (2006.01)

(52) U.S. Cl. ..... 137/801; 4/678

(58) Field of Classification Search ..... 137/801; 4/678

See application file for complete search history.

(56) References Cited

U.S. PATENT DOCUMENTS 5,669,417 A 9/1997 Lian-Jie ..... 137/801
5,865,477 A * 2/1999 Ko ..... 285/276
5,924,451 A * 7/1999 Kuo ..... 137/801
6,085,784 A * 7/2000 Bloom et al. ..... 137/606
6,360,770 B1 * 3/2002 Buchner et al. ..... 137/315.12
6,405,749 B1 * 6/2002 Bloom et al. ..... 137/359
6,817,379 B1 * 11/2004 Perla ..... 137/801

* cited by examiner

*Primary Examiner*—John Fox
(74) *Attorney, Agent, or Firm*—Troxell Law Office, PLLC

(57) ABSTRACT

A water-flow guide device of faucet, which comprises a hollow space, a water outlet mounted with a positioning ring having a hole; one end thereof is riveted with a threaded connector, and then is inserted into the other end of the faucet; the other end of the water-supply pipe is riveted with a ring-shaped fastener, which is attached to the outer surface of a positioning ring; then, a washer and a bubble head are fastened to the outer end of the pipe; the other end of the water-supply pipe is connected with a T-shaped connector via a threaded connector so as to enable a cold-water valve and a hot-water valve to control the water to flow out of the water pipe without contact with the body of the faucet.

2 Claims, 6 Drawing Sheets

WATER-FLOW GUIDE DEVICE OF FAUCET

BACKGROUND OF THE INVENTION

1. Field of the Invention

This invention relates to a faucet, and particularly to a faucet to prevent the water flow from contact with the cast faucet body, which is subject to diluting lead material into the water to jeopardize a person's health.

2. Description of the Prior Art

In a conventional faucet, the faucet is usually welded to connect with a copper pipe; to weld a copper pipe is a cumbersome work, and the outer part thereof is ornamented with an allay containing lead and zinc; then, the surface thereof is processed with electroplating; however, such surface is subject to oxidizing in case of being slightly damaged.

Another conventional faucet is cast into an artistic form with brass, and water inlet is directly connected with a water valve, i.e., water flows substantially through a passage therein and a bubble head. The faucet cast usually contains a high percent lead, which will be diluted into water; after a person drinks such water for a long period of time, a given amount of lead will be accumulated in body, and it is harmful to human health.

A faucet made of low-lead may conform to the requirements of environmental protection and health protection before being processed with an electric-plating; as soon as the faucet is processed through an electric-plating, a jeopardized stuff will be left on the surface of the body of the faucet; if such jeopardized stuff is not removed, it will exist in the drink water to came a jeopardized result to a person's health in the long run.

Another conventional patent, U.S. Pat. No. 5,669,417, discloses that the faucet can provide the aforesaid object; however, it would result in a maintenance difficulty after long time use; in other words, its production cost is too high to become a commercial product.

SUMMARY OF THE INVENTION

The prime object of the present invention is to provide a water-flow guide device of faucet, wherein the body of the faucet has a hollow space for receiving a water-supply pipe to insert in place from the water outlet; then, the water-supply pipe can extend to a T-shaped connector; a valve rod is used for controlling the water flow, and the water can flow through the water-supply pipe to the bubble head directly without contact with the body of the faucet which usually contains heavy lead.

Another object of the present invention is to provide a water-flow guide device of faucet, wherein the body of the faucet has a hollow space for receiving a water-supply pipe; one end of the water-supply pipe is riveted with a ring-shaped fastener, while the other end thereof is riveted with a threaded connector so as to have the water-supply pipe inserted into the water outlet of the body of faucet; the ring-shaped plate of the ring-shaped fastener is attached to a positioning ring; the outer end thereof is mounted with a washer and a bubble head; the other end of the water-supply pipe extends through the hollow space, and is connected with a hexagonal connector of the T-shaped connector; water flow is controlled with a valve rod, and the water can flow through the T-shaped connector, water-supply pipe, and the bubble head without contact or touch the body of the faucet.

A still another object of the present invention is to provide a water-flow guide device of faucet, wherein one end of the water-supply pipe is mounted with a ring-shaped fastener by means of a rivet member, while the other end thereof is mounted with a threaded connector which is fastened in place by means of a rivet member; the smaller diameter end of the threaded connector is inserted into the outlet of the water-supply pipe, and then goes through the hollow space to the other end of the water-supply pipe for easy and simple assembling operation.

A further object of the present invention is to provide a water-flow guide device of faucet, wherein one end of the water-supply pipe is mounted with a ring-shaped fastener, which enables the ring-shaped plate to attach to a positioning ring, and to facilitate a washer and a bubble head to mount in place after the water-supply pipe being pulled in a proper position; then, water can flow out of the bubble head.

A still further object of the present invention is to provide a water-flow guide device of faucet, wherein one end of the water-supply pipe is furnished with a threaded portion and seal ring to be fastened together with the threaded hole of a T-shaped connector; then, the water-supply pipe can be connected with the valve cold rods of the cold water pipe and the hot water pipe; after the valve rod is turned on, the water will flow out through the T-shaped connector, the water-supply pipe and the bubble head; the device can provide a simply and easy way for installation and maintenance of the faucet assembly.

DETAILED DESCRIPTION OF THE PREFERRED EMBODIMENT

Figure 1:
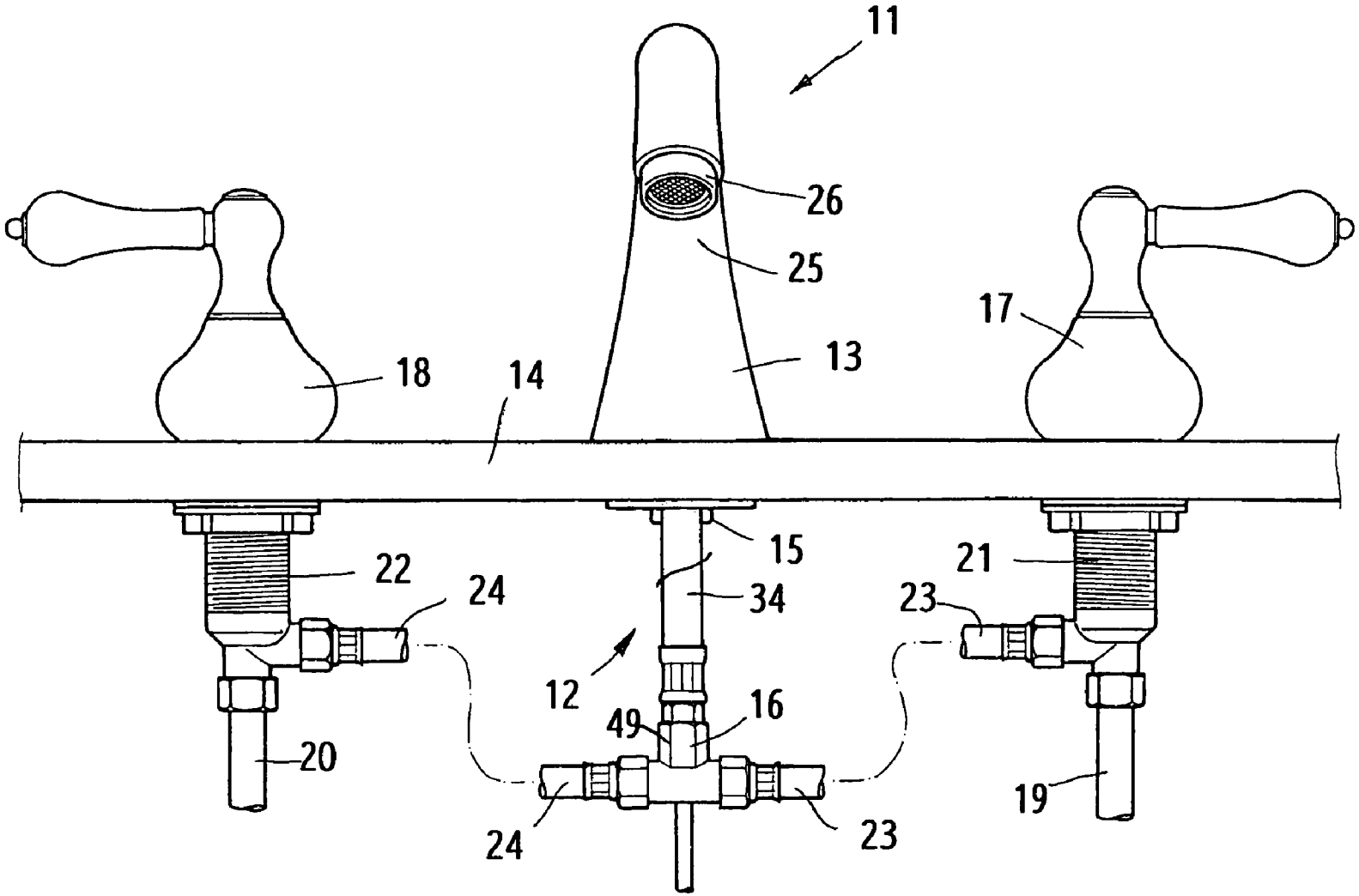
FIG. 1 is a plan view of the present invention.

This invention relates to a water-flow guide device of a faucet; as shown in FIG. 1, the body 13 of the faucet 11 is fastened to a platform 14. Two valve rods 17 and 18 are mounted on both sides of the faucet 11 respectively. The lower ends of the two valve rods 17 and 18 are mounted with two valves 21 and 22 respectively. One end of valve 21 is connected with a cold water pipe 19, while other end thereof is connected with a T-shaped connector 16 through a cold water pipe 23. One end of the valve 22 is connected with a hot water pipe 20, while other end thereof is connected with the T-shaped connector 16 through a hot water pipe 24; the other end of the T-shaped connector 16 is connected with a guide device 12. The water outlet 25 of the body 13 of faucet 11 can provide a mixed water flow (i.e., cold and hot water).

Referring to FIGS. 1, 2, 4 and 5, the body 13 of faucet 11 is made of brass, and it is a hollow member; the outer surface of the faucet is to be polished or plated; one end of the faucet is mounted with a guide device 12, a ring-shaped fastener 44 and a positioning ring 37; the outer end of the ring-shaped fastener is furnished with threads for fastening a bubble head 26. The other end of the body 13 is furnished with a positioning ring 28 to be mounted in a mounting hole 27 of the platform 14. The body 13 is furnished with a drainage rod 33 in a cylindrical hole, of which the lower end is mounted with a hollow pipe 32; the hollow pipe 32 extends through the platform 14, and is fastened in place by means of a fixing plate 30 and a nut 31 so as to fasten the body 13 of faucet 11 on the platform 14.

The body 13 of faucet 11 above the platform 14 has a hollow space therein; the water outlet 25 thereof is furnished with a positioning ring 37; of which the center has a hole 38; the outer end of the positioning ring 37 is furnished with threads. The water-supply pipe 34 is to be mounted through the water outlet 25, and extends into the hollow space 41; before the water-supply pipe 34 is assembled, the pipe body 40 is mounted with a sleeve pipe 60 at one end thereof; the sleeve pipe 60 has a round hole in the center thereof enable a fastener 44 to mount into the cylindrical hole of the pipe body 40. The outer end of the sleeve pipe 60 has a ring-shaped plate 36, of which the diameter is slightly larger than that of the sleeve pipe, and the center of the ring-shaped plate 36 is furnished with a through hole. The sleeve pipe 60 is riveted into a rivet member 39 so as to have the ring-shaped fastener 44 fastened to the end of the pipe body 40; then, the pipe body 40 and the ring-shaped fastener 44 connected together can withstand a high pressure of water. The other end of the pipe body 40 is mounted in a sleeve pipe 61; then, a threaded connector 43 is mounted into the sleeve pipe 61. The outer end of the threaded connector 43 is furnished with a hexagonal rod 48, a ring-shaped groove 46 for receiving an O-ring 47, and a threaded portion 45. The center of the threaded connector 43 has a through cylindrical hole 51. The sleeve pipe is pressed into a rivet member 42 so as to have the threaded connector 43 fastened to the end of the pipe body 40, and to enable the pipe body 40 and the threaded connector 43 connected together to withstand a high pressure of water.

The pipe body 40 of the water-supply pipe 34 is a hose without poison and being safe for drinking water; the outer surface of the hose is covered with a sleeve knitted with a stainless steel wire. One end of the pipe body 40 is riveted with a fastener 44; the outer end thereof is furnished with a ring-shaped plate 36 having a larger diameter, while other end thereof is riveted with a threaded connector 43, which has a threaded portion 45 having a diameter slightly less than that of the rivet member 42. When the water-supply pipe 34 and the body 13 of the faucet 11 are assembled together, the threaded connector 43 should be inserted into the hole 38 in the water outlet 25 through the hollow space 41 until the rivet member 39 sat in the hole 38; then, the ring-shaped plate 36 is in contact with the outer surface of the positioning ring 37; the threaded end of the bubble head 26 mounted with a washer 35 is screwed to the threaded portion of the water outlet 25 of the body 13; then, the positioning ring 37 and the ring-shaped plate 36 will be mounted in place by means of the bubble head 26.

A washer 35 is mounted between the bubble head 26 and the ring-shaped plate 36 to prevent from leaking so as to provide a perfect water outlet 25.

The threaded connector 43 mounted on the other end of the water-supply pipe 34 in the hollow space 41 includes a hexagonal stub 48, a threaded portion 45, a ring-shaped groove 46 and an O-ring 47; the threaded connector 43 is connected, by means of threads, with a T-shaped connector 16, of which two side-connectors are furnished with outer threads so as to connect with a cold-water pipe 23 and a hot-water pipe 24 respectively; the other ends thereof are connected with two valve connectors 21 and 22 respectively. When the valve rod 17 or 18 is turned to have a cold or hot water flowed through, the cold and hot water will be mixed in the T-shaped connector 16 to flow out of the water outlet 25.

According to the present invention, one end of the water-supply pipe 34 in the guide device 34 is mounted with a ring-shaped fastener 44, which includes a ring-shaped plate 36 on the outer end thereof and a threaded connector 43 on the other end thereof; the threaded connector 43 includes a hexagonal stub 48 and a threaded portion 45. The smaller diameter end of the water-supply pipe 34 is inserted into the water outlet 25 of the faucet 11; the ring-shaped fastener 44 is closely attached to the positioning ring 37 in the water outlet 25; the outer end thereof is mounted with the bubble head 26; the other end of the water-supply pipe 34 is fastened to the T-shaped connector 16, which is connected with the cold-water pipe 23 and the hot-water pipe 24. After a cold and a hot water are mixed and flowed to the water outlet 25, the water flow would not contact with the body 13 of the faucet 11. In case of a repair being necessary, the bubble head 26 can be disassembled by loosening the threaded connector 43; then, the water-supply pipe 34 can be pulled out easily to replace it with a new one.

Figure 2:
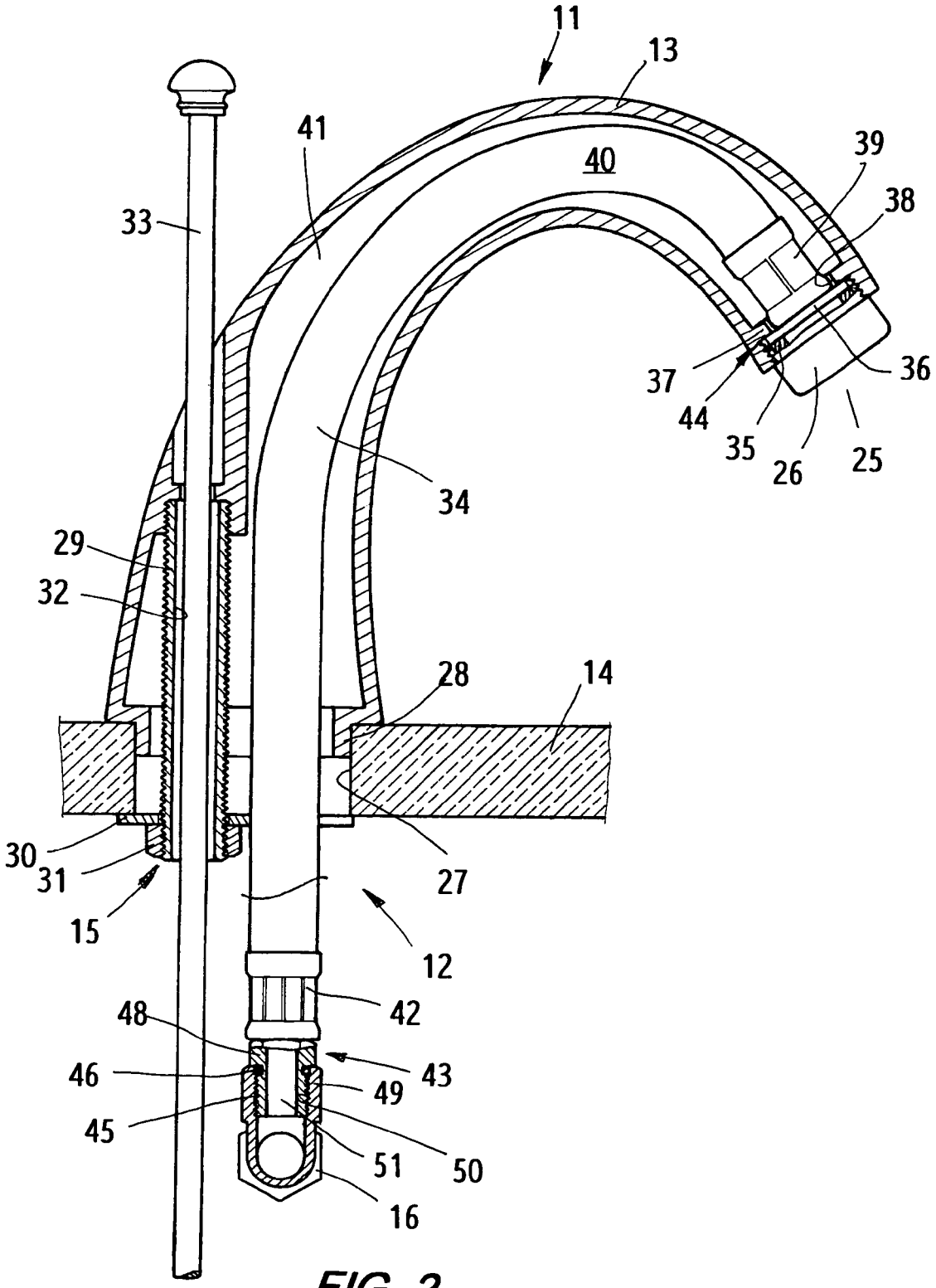
FIG. 2 is a sectional view of the present invention, showing the structure of embodiment-1.
Figure 3:
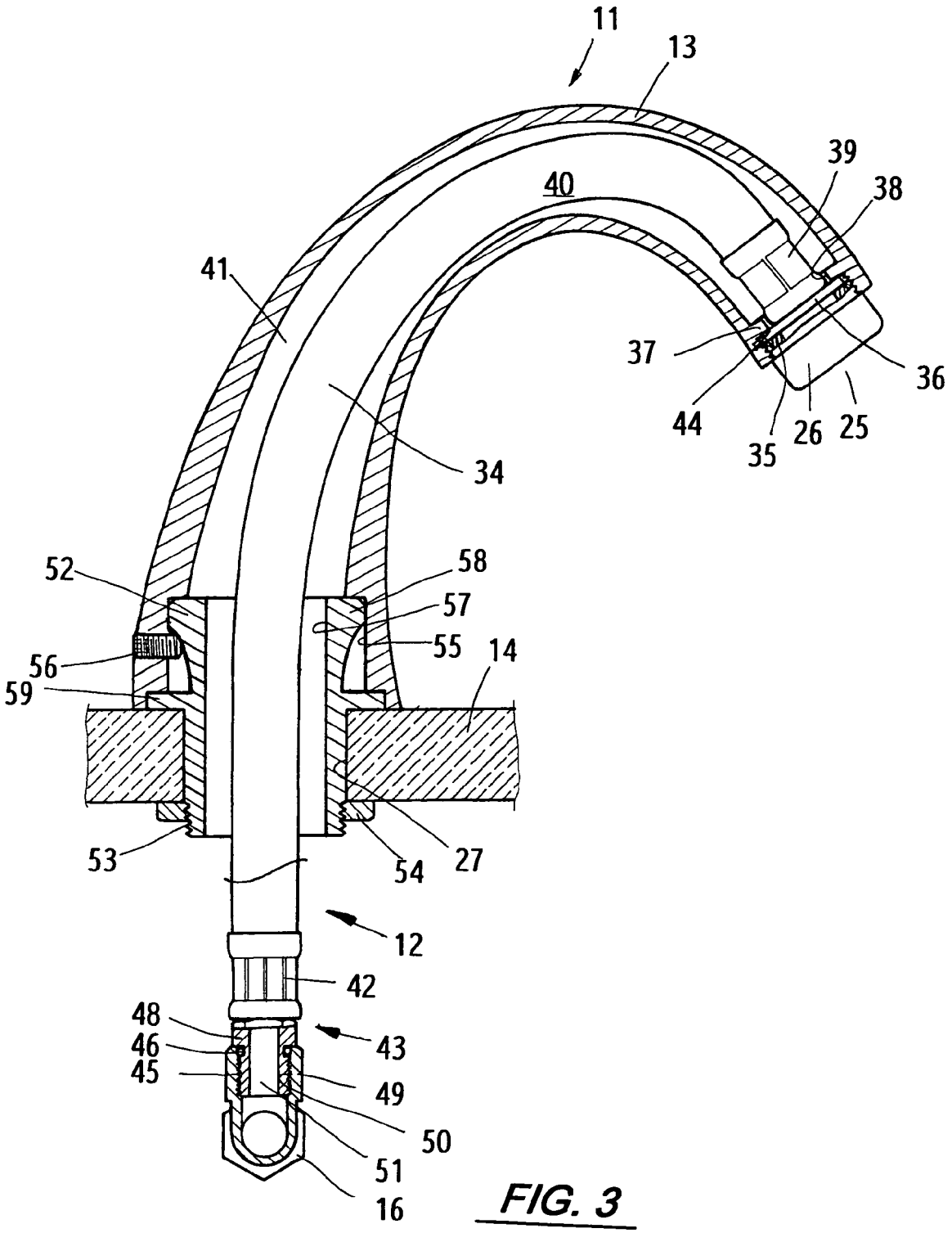
FIG. 3 is a sectional view of the present invention, showing the structure of embodiment-2.
Figure 4:
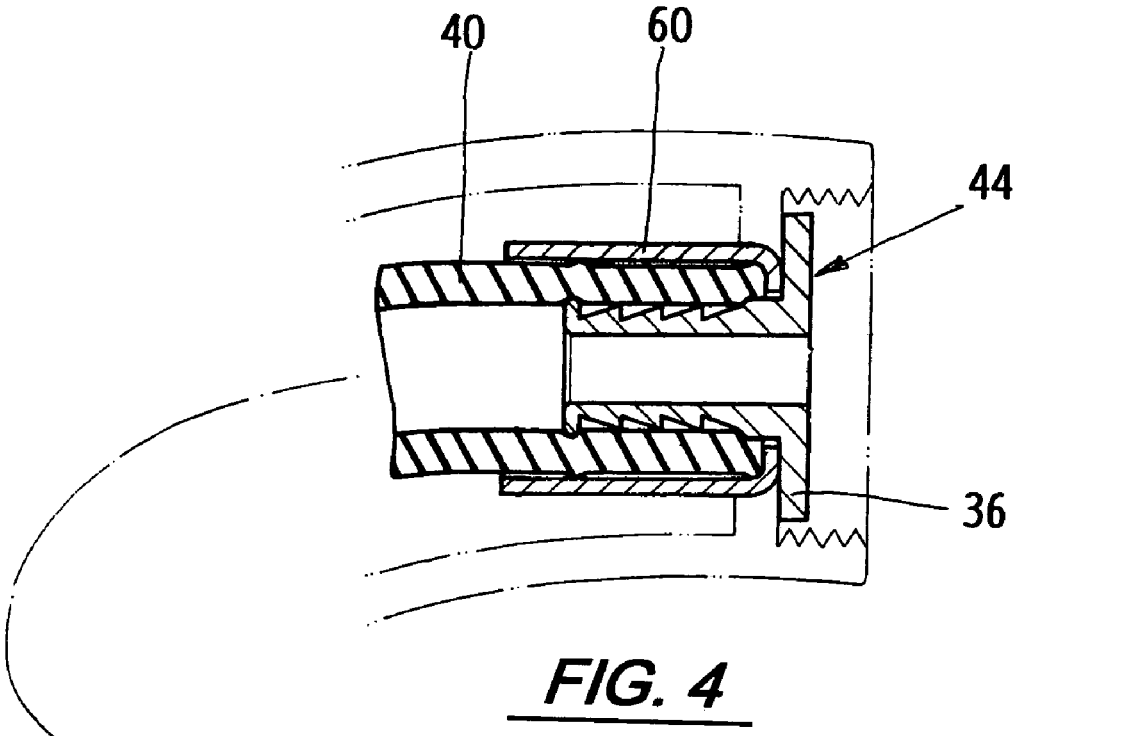
FIG. 4 is a sectional view of the present invention, showing an end assembly of the water-supply pipe.
Figure 5:
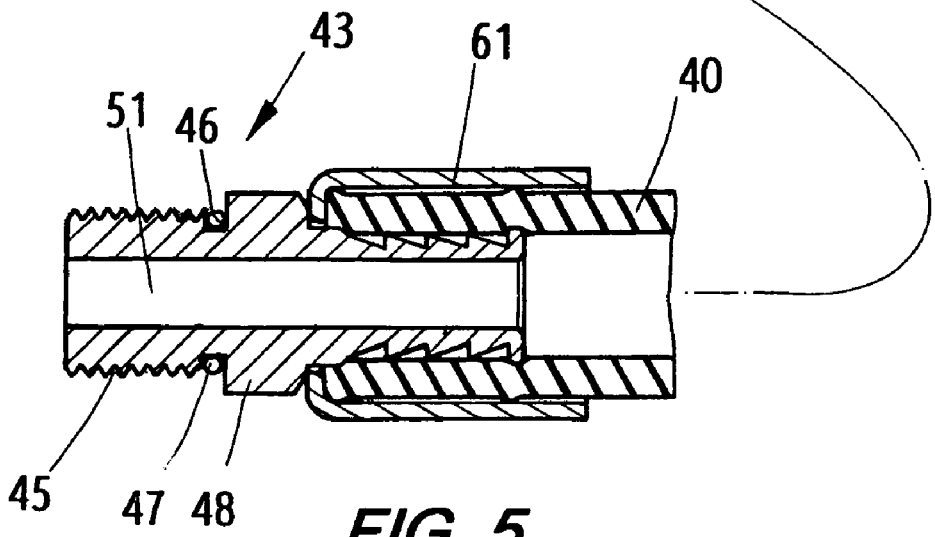
FIG. 5 is a sectional view of the present invention, showing another end assembly of the water-supply pipe.

In addition to the method of fastening the body 13 of the faucet 11 as shown in FIG. 2, the body 13 of the faucet 11 may be mounted in place with a positioning sleeve 52 mounted on the platform 14 by means of a screw 56. The positioning sleeve 52 includes a cylindrical stub 58, a positioning ring 59, a threaded pipe 53 and a nut 54; the cylindrical stub 58 is designed to fit in the positioning hole 55; the positioning ring 59 is designed to fit in the mounting hole 27 of the platform 14; after the threaded pipe 53 is mounted through the mounting hole 27 of the platform 14, and the positioning ring is attached to the mounting hole 27, the threaded pipe 53 will also go through the mounting hole 27 of the platform 14, and then it is fastened in place with a nut 54 so as to have the positioning sleeve 52 fixed in the mounting hole 27 of the platform 14.

The lower end of the body 13 of the faucet 11 assembled together with the positioning sleeve 52 is furnished with a positioning hole 55 to be mounted to the cylindrical stub 58 of the positioning sleeve 52, and the positioning hole 55 is used for adjusting the position of the body 13, and then the body 13 can be fixed in place with nut 56.

After the water-supply pipe 34 and the related parts are assembled together, the faucet 11 will be ready for mounting; first, the positioning sleeve 52 is fastened on the platform 14; then, the water-supply pipe 34 is mounted through the cylindrical hole 57 of the positioning sleeve 52; the threaded connector 43 is connected with the T-shaped connector 16, and the assembling work is done.

Figure 6:
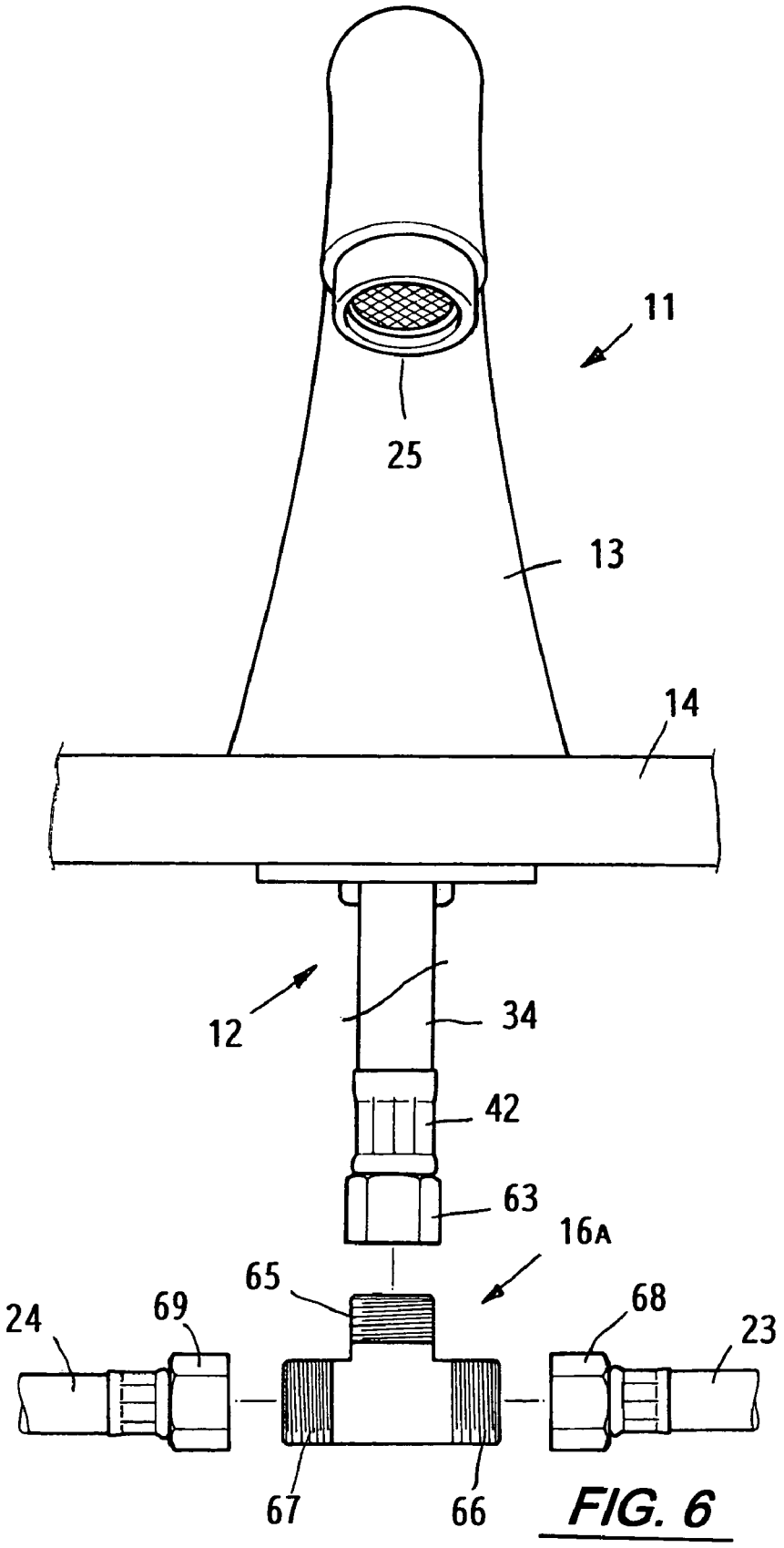
FIG. 6 is a front view of the present invention, showing an embodiment-3 thereof.
Figure 7:
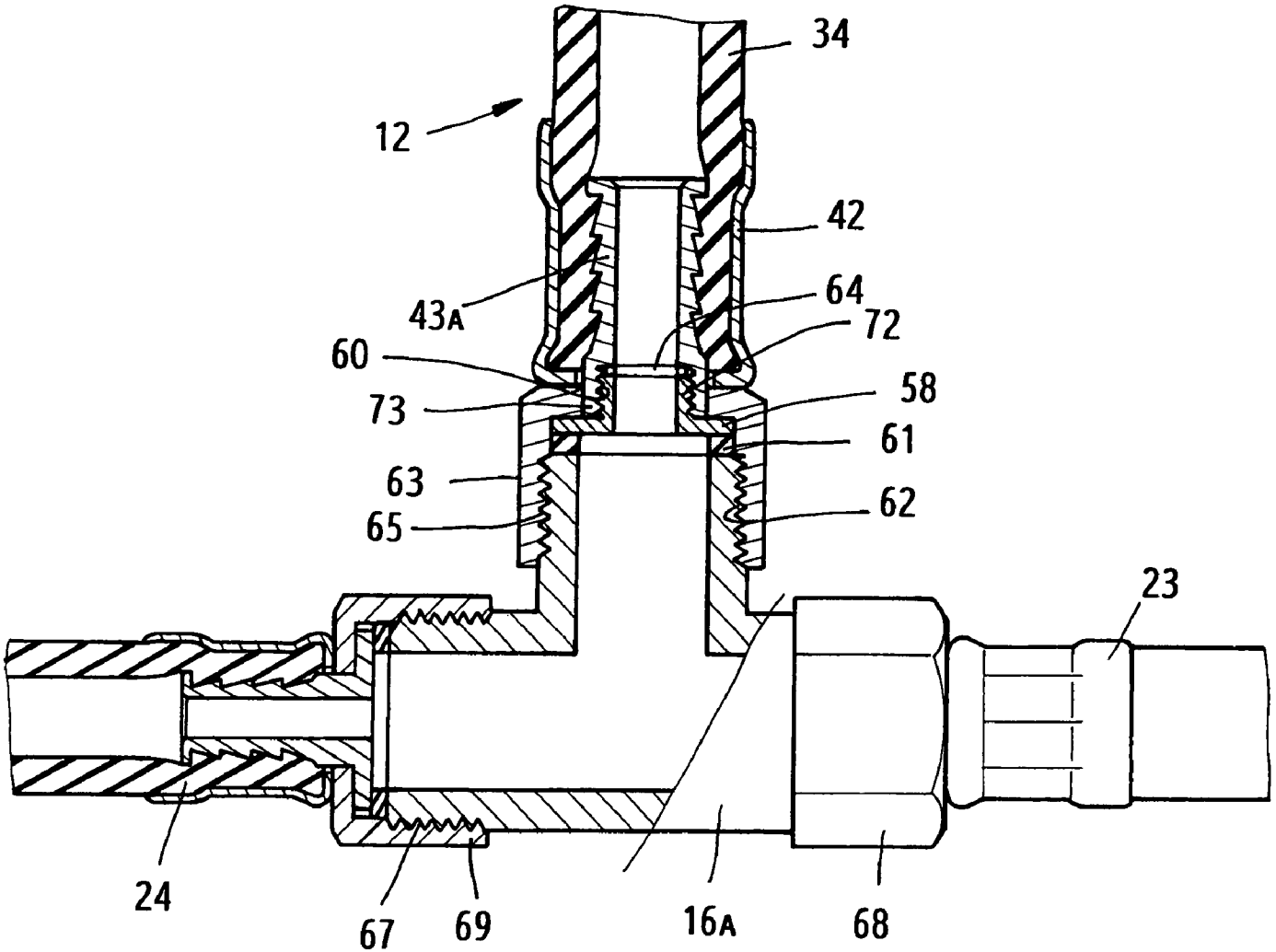
FIG. 7 is a sectional view of the present invention, showing an embodiment-3 thereof.

Referring to FIGS. 6 and 7, the T-shaped connector 16A under the platform 14 is a conventional three-way connector, of which the outer surfaces of the three connecting ends are furnished with the same standard outer threads 65, 66 and 67 respectively; the two outer threads 66 and 67 are to be connected with a cold-water pipe 23 and a hot-water pipe 24 through two hexagonal nuts 68 and 69 respectively, while the other threads 65 are connected with a hexagonal nut 63 of a water-supply pipe 34 so as to have the water in the cold-water pipe 23 and the hot-water pipe 24 flowed out of water outlet 25 of the body 13.

The diameter of the hexagonal nut 63 on the water-supply pipe 34 is slightly bigger than that of the bubble head 26 of the body 13 of the faucet 11; the water-supply pipe 34 can be inserted into the water outlet 25 of the body 13; the other end of the water-supply pipe 34 is riveted with a threaded connector 43A, of which the diameter is smaller than that of the rivet member 42 so as to facilitate the water-supply pipe 34 to insert into the water outlet 25 of the body 13, and to insert through the hollow space 41 of the body 13 in the faucet 11.

The outer end of the threaded connector 43A is furnished with a stub 71 having threaded hole 60 in the center thereof; the bottom of the threaded hole 60 is mounted with a washer 64; then, a hexagonal nut 63 with threads 62 is mounted to a stub 71 of the threaded connector 43A, and then the threaded hole 60 of the stub 71 is set in the inner space of the hexagonal nut 63. A ring-shaped plate 58 with a through hole having a threaded stub 72 is set in the threaded hole 60 of the stub 71 of the threaded connector 43A. A washer 64 is mounted between the threaded stub 72 and the stub 72 of the threaded connector 43A so as to prevent from leakage of water.

A threaded connector 43A riveted to one end of the water-supply pipe 34 has a stub 71 to be mounted into the hexagonal nut 63, while the ring-shaped plate 58 of the threaded stub 72 is mounted on the center bottom of the hexagonal nut 63 so as to have the hexagonal nut 63 turned freely. The outer edge of the ring-shaped plate 58 in the center bottom of the hexagonal nut 63 is mounted with a washer 61 so as to enable the hexagonal nut 63 on the water-supply pipe 34 to fasten to the outer threads 65 of the T-shaped connector 16A, and to enable the water-supply pipe 34 and the T-shaped connector 16A to connect together; then, water can flow out of the water outlet 25 through the water-supply pipe 34.

The hexagonal nut 63 mounted on the outer threads 65 of the T-shaped Connector 16A can be connector together with the stub 71 of the threaded connector 43A on the water-supply pipe 34 by means of a washer 61 on the threaded stub 72 upon the water-supply pipe 34 reaching the other end of the faucet 11. The water-supply pipe 34 is mounted with a hexagonal nut 63, of which the threads 62 can be connected with the T-shaped connector 16A, which is furnished with outer threads 65; in other words, the faucet 11 can be assembled simply and easily.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. A water-flow guide device of faucet, in which a water outlet of a faucet is furnished with a threaded portion for mounting a bubble head; said threaded portion furnished with a positioning ring having a through hole in center thereof; bottom of said faucet is fastened together with a platform; body of said faucet having a hollow space; between a water inlet and a water outlet of said faucet, a water guide device is mounted, and said water guide device comprises:

a water-supply pipe including:

a pipe body being substantially a hose having no poison, and outer surface of said hose being covered with a sleeve knitted with stainless steel wire; one end of said body riveted with a ring-shaped fastener, while other end thereof riveted with a threaded connector;

a ring-shaped fastener having a ring-shaped plate with larger diameter than that of said pipe body, and a stub inserted in a cylindrical hole of said pipe body, and said stub having a through cylindrical hole in center thereof;

a rivet member mounted on end of said pipe body; said rivet member having a cylindrical hole for mounting a ring-shaped fastener; said rivet member being riveted to one end of said pipe body;

a threaded connector furnished with a short stub on one end thereof to be inserted in a cylindrical hole of end of said pipe body, while other end thereof furnished with a hexagonal stub; said threaded connector also including a ring-shaped groove for receiving an O-ring, a threaded portion having a through hole in the center thereof;

a rivet member mounted on end of said pipe body, and said rivet member having a center hole for receiving a threaded connector which is riveted on end of said pipe body; and a T-shaped connector furnished with two side connectors having outer threads so as to connect with a cold-water pipe and a holt-water pipe respectively; another end of said T-shaped connector furnished with a hexagonal connector having a threaded hole for connecting with a threaded connector of a water-supply pipe.

2. A water-flow guide device of faucet, in which a water outlet of a faucet is furnished with a threaded portion for mounting a bubble head; said threaded portion furnished with a positioning ring having a through hole in center thereof; bottom of said faucet is fastened together with a platform; body of said faucet having a hollow space; between a water inlet and a water outlet of said faucet, a water guide device is mounted, and said water guide device comprises:

a water-supply pipe including:

a pipe body being substantially a hose having no poison, and outer surface of said hose being covered with a sleeve knitted with stainless steel wire; one end of said body riveted with a ring-shaped fastener, while other end thereof riveted with a threaded connector;

a ring-shaped fastener having a ring-shaped plate with larger diameter than that of said pipe body, and a stub inserted in a cylindrical hole of said pipe body, and said stub having a through cylindrical hole in center thereof;

a rivet member mounted on end of said pipe body; said rivet member having a cylindrical hole for mounting a ring-shaped fastener; said rivet member being riveted to one end of said pipe body;

a rivet member mounted on outer end of said pipe by means of a sleeve, and said rivet member having a cylindrical hole in center thereof to enable said threaded connector to pass through and then riveted on end of said pipe body;

a hexagonal nut furnished with threads in center thereof, and having a through hole on bottom thereof, and said through hole being mounted on a stub of said threaded connector;

a ring-shaped plate furnished with a threaded stub and a cylindrical through hole; said threaded stub passing through a threaded space of said hexagonal nut to be connected together with a threaded hole of a stub of said threaded connector;

a washer mounted on bottom of said threads of said hexagonal nut and being attached to said ring-shaped plate; and a T-shaped connector furnished with two connectors having threads respectively; said two connectors to be connected with a cold-water pipe and a hot-water pipe respectively by means of threads, while other end of said T-shaped connector furnished with outer threads to be connected together with said hexagonal nut on said water-supply pipe.

* * * * *